United States Patent [19]

Maggiore

[11] Patent Number: 4,520,565

[45] Date of Patent: Jun. 4, 1985

[54] HAIR CUTTING GUIDE APPARATUS AND METHOD

[76] Inventor: Lynne D. Maggiore, 229 Continental La., Schaumburg, Ill. 60194

[21] Appl. No.: 545,891

[22] Filed: Oct. 27, 1983

[51] Int. Cl.[3] ..... A45D 24/36

[52] U.S. Cl. ..... 30/201; 132/45 R; 30/233

[58] Field of Search ..... 30/200, 201, 233, 233.5, 30/286; 132/45, 45 A, 45 B; 24/346

[56] References Cited

U.S. PATENT DOCUMENTS

| | | | |
|---|---|---|---|
| 1,806,486 | 5/1931 | Mirafuentes | 7/136 |
| 2,688,186 | 9/1954 | Kraepelin | 30/233 |
| 3,060,536 | 10/1962 | La Voie | 24/346 |
| 3,928,871 | 12/1975 | Wall | 132/45 R |
| 3,972,337 | 8/1976 | Pomaro | 132/45 R |
| 3,993,083 | 11/1976 | Torres | 132/45 R |
| 4,269,205 | 5/1981 | Clark | 132/45 R |
| 4,428,124 | 1/1984 | Asakura | 30/233 |

FOREIGN PATENT DOCUMENTS

| | | | |
|---|---|---|---|
| 2435926 | 5/1980 | France | 132/45 R |

*Primary Examiner*—Jimmy C. Peters

*Attorney, Agent, or Firm*—Douglas B. White

[57] ABSTRACT

An apparatus for cutting hair at a predetermined measured length is provided using a clip device having a first and second jaw member, whereby each jaw member has a clamping portion and a handle member. Pressure applied to the handle members causes the clamping portion to separate, such that a section of hair may be encompassed thereby. Depending from the first jaw member are base spacer attachments arranged to rest on the scalp while grasping the section of hair between the clamping portions. This allows for manual trimming with scissors along the upper edge of the clamping portion. Said section of hair is therefore cut at a predetermined length measured by the combination of the height of the jaw member and the size of the spacer attachments selected.

1 Claim, 4 Drawing Figures

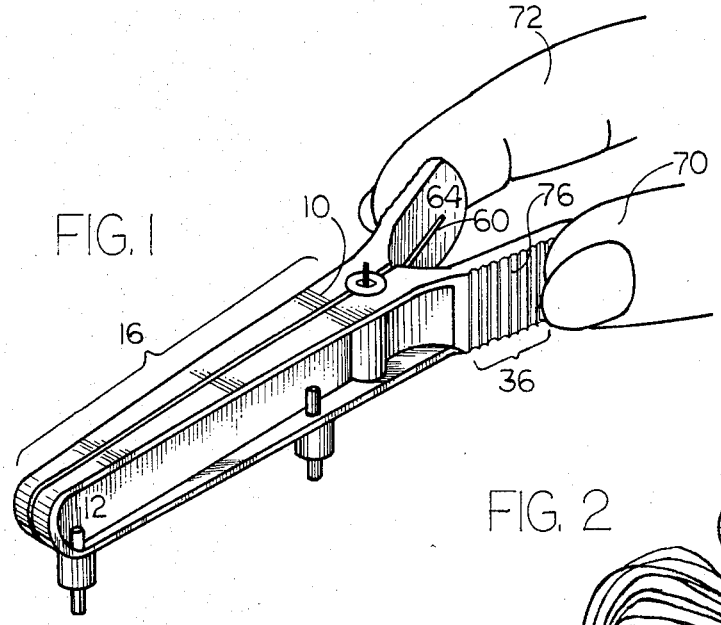
FIG. 1
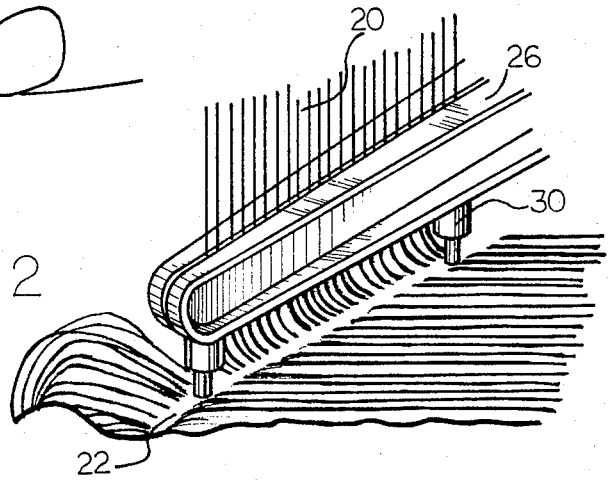
FIG. 2
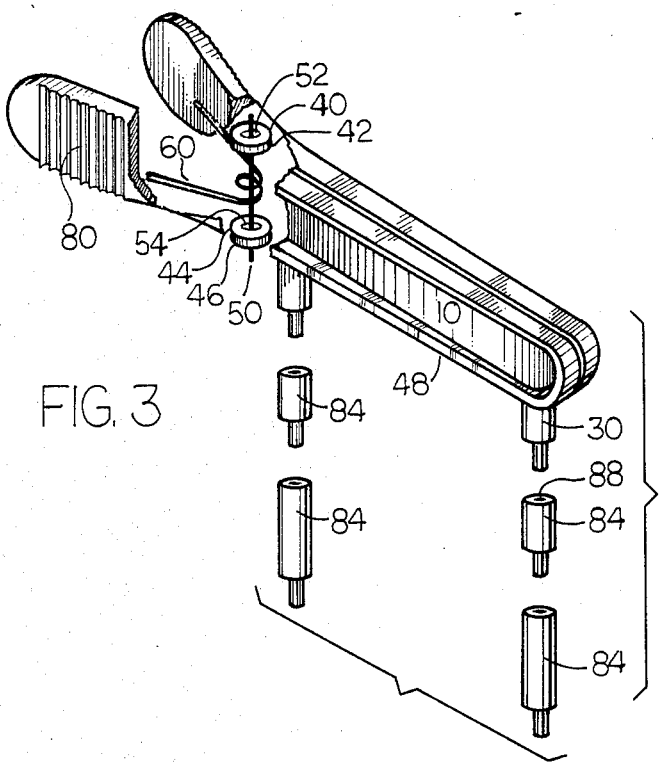
FIG. 3
FIG. 4
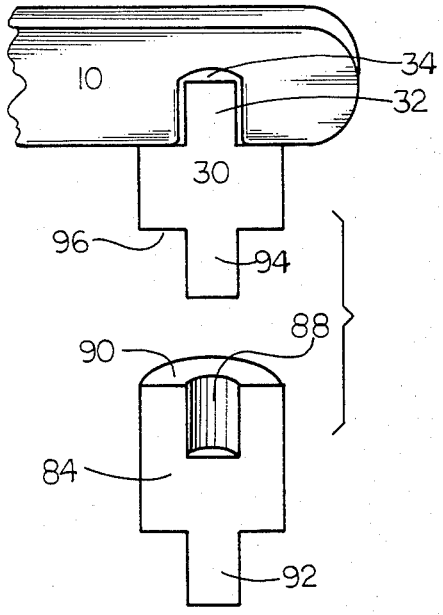

HAIR CUTTING GUIDE APPARATUS AND METHOD

BACKGROUND OF THE INVENTION

This invention relates generally to an apparatus and method for cutting hair, and more particularly this invention relates to improved features of said device providing spacing means to measure a predetermined length of hair for cutting purposes.

Previous items have dealt with hair clamping devices such as the tweezer-like clip, Swedish Pat. No. 50,101, granted to Bokuist. But this patent, like all common hair clips, does not provide measuring means to facilitate accurate hair trimming. Common hair clips are represented in U.S. Pat. No. 3,242,563 issued to Longhini, and U.S. Pat. No. 3,983,887, issued to Chan.

Secure clamping of hair for trimming is provided in the Torres reference, U.S. Pat. No. 3,993,083, wherein a pair of congruent rectangular plates, each having a first edge hinged to that of the other, is used to secure hair therebetween.

In the field of spacing devices for hair trimming purposes, the Kraepelin reference, U.S. Pat. No. 2,668,186, describes a spacing block attached directly to the scissors. In the patent granted to Pomoro, U.S. Pat. No. 3,972,337, there is described a comb-like member secured to scissors by a telescoping adjustment. In the patent granted to Clark, et. al., U.S. Pat. No. 4,269,205, there is described a thumb gauge having support means adapted to fit around the thumb of a user and rested on the scalp. The hair is then held between the fingers while being trimmed.

In contrast to the foregoing, the present invention provides for an improved hair cutting apparatus and method wherein the clamping portion of the clip mechanism is used to hold a section of hair in a spaced relation from the scalp. The user is allowed to select a predetermined measure of hair to trim through the use of spacer attachments.

SUMMARY OF THE INVENTION

Accordingly, it is a principal object of the present invention to provide a hair cutting apparatus which acts as a guide for the user.

A further object of the present invention is to provide the ability to easily adjust the guide to alternate lengths of hair for trimming.

Yet a further object of the present invention is an apparatus which is universally applicable to different types of hair.

Other objects and advantages of the invention will become apparent upon reading the following detailed description and upon reference to the drawings, in which:

FIG. 1 is a perspective view of the apparatus;

FIG. 2 is a perspective view of a portion of the apparatus in operation;

FIG. 3 is a perspective view of the apparatus with additional attachments properly aligned for addition and a cutaway view of the clip interlocking means; and FIG. 4 is a cutaway view of the additional spacer attachment feature.

While the invention will be described in connection with the preferred embodiment, it will be understood that I do not intend to limit the invention to that embodiment. On the contrary, I intend to cover all alternatives, modifications and equivalents as may be included within the spirit and scope of the invention as defined by the appended claims.

DESCRIPTION OF THE PREFERRED EMBODIMENT

Turning now to the drawings there is shown a preferred embodiment of the present invention for cutting hair at a predetermined measured length. More particularly, referring to FIG. 1, there is a perspective view of a hair cutting guide apparatus having a first and second jaw member 10 and 12. In operation, the clamping portion 16 of the jaw members 10 and 12 is used to hold a section of hair 20 in a predetermined measured length from the scalp 22 (FIG. 2) for trimming along the upper edge 26 of the clamping portion 16. Said predetermined measured length is determined by the height of said first and second jaw members 10 and 12. In the alternative, said length may be the result of said height in combination with base spacer attachments 30. Securing of said base spacer attachments is performed by aligning the nipple portion 32 of said base spacer attachment 30 below the cavity 34 of said first jaw member 10. The nipple is then mated by force fit with the cavity of the first jaw member (FIG. 4).

Returning to FIG. 1, there is shown a spring-loaded, pivoting apparatus for trimming hair at a predetermined measured length. The apparatus comprises a first and second interlocking jaw member 10 and 12, each jaw member having a clamping portion 16 and a handle member 36. In the preferred embodiment of the present invention, as depicted in the cutaway view of FIG. 3, the interlocking means comprises extending portions 40 and 42 on the upper edge 26, and extending portions 44 and 46 on the lower edge 48 of the jaw members. By overlapping said extending portions 40, 42, 44, 46 a pin 50 may be passed through corresponding apertures 52 and 54 thus securing and maintaining the jaw members in an interlocked position.

Supporting the jaw members 10 and 12 and urging the clamping portions 16 in a juxtaposed position is a spring member 60. Said spring member applies pressure on the inner portion 64 of the handle members of said jaw members 10 and 12, and is secured by encircling the spring member 60 around the pin 50.

In the method of the preferred embodiment of the present invention, a comb or fingers may be used to grasp a portion of hair 20. Applying pressure to the handle members 36 using the thumb 70 and index finger 72, as shown in FIG. 1, against the gripping ridges 76 and 80, causes the clamping portions 16 of the jaw members 10 and 12 to separate.

The apparatus is then moved to encompass the raised portion of hair 20. Pressure being applied to the handle members 36 is then released to secure the portion of hair 20 between the clamping portion 16 of the jaw members. Simultaneously performed with this clamping process is the placing of the base spacer attachments 30 on the scalp 22. The base spacer attachments 30 in combination with the height of the jaw members 16 gives the user a predetermined measure of hair available for trimming. Finally, a scissors (not shown) is used to cut the hair along the upper edge 26 of the clamping portion 16.

In a further feature of the present invention, additional spacer attachments 84 may be added to the existing base spacer attachments 30 as illustrated in FIG. 3, to obtain alternate measured lengths of hair available for trimming. Each additional attachment 84 is seen as having a center cavity 88 on the flat upper surface 90 and a nipple 92 depending therefrom (further illustrated in FIG. 4). Attachment is performed by aligning the center cavity 88 of the additional spacer 84 below the nipple portion 94 of the base spacer 30. The nipple 94 is then mated by force fit with the cavity 88 of the additional spacer 84. Said cavity 88 in this position encompasses the nipple 94 as the flat surface 90 of the additional spacer 84 becomes flush with the lower surface 96 of the base spacer 30.

In summary, a hair cutting guide apparatus and method is provided having a clamping device comprised of a first and second jaw member, each jaw member having a clamping portion and a handle member where pressure applied to the handle members causes the clamping portion to separate. When expanded, a section of hair may then be encompassed and held securely. Depending from the first jaw member are base spacer attachments, whereby resting the base spacer attachments on the scalp while grasping a section of hair between the clamping portions, the operator may then trim along the upper edge of the clamping portion. Said section of hair is therefore cut at a predetermined measured length through the combination of the height of the jaw member and the size of the spacer attachment selected.

I claim:

1. A hair cutting guide apparatus comprising:

a first and second jaw member;

means for urging said jaw members in position one against the other;

a plurality of extending portions depending from said first jaw; and means for increasing the length of said extending portions comprising a plurality of spacers of predetermined length arranged for removable attachment to said first jaw member.

* * * * *